US008579604B2

(12) United States Patent
Liang et al.

(10) Patent No.: US 8,579,604 B2
(45) Date of Patent: Nov. 12, 2013

(54) FLOATING APPARATUS FOR SCROLL COMPRESSORS

(75) Inventors: Kun-Yi Liang, Hsinchu County (TW); Yu-Choung Chang, Hsinchu County (TW); Shu-Er Huang, Hsinchu (TW); Chun-Chung Yang, Hsinchu (TW); Chi-Hsing Chen, Hsinchu County (TW); Yueh-Ju Tang, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 383 days.

(21) Appl. No.: 13/030,731

(22) Filed: Feb. 18, 2011

(65) Prior Publication Data

US 2012/0148433 A1 Jun. 14, 2012

(30) Foreign Application Priority Data

Dec. 9, 2010 (TW) ..... 99142952 A

(51) Int. Cl.
*F04B 17/00* (2006.01)

(52) U.S. Cl.
USPC ..... 417/410.5; 417/292; 417/308

(58) Field of Classification Search
USPC ..... 417/410.5, 292, 307, 308; 418/55.1–55.6
See application file for complete search history.

(56) References Cited

U.S. PATENT DOCUMENTS 5,141,407 A 8/1992 Ramsey et al.
5,607,288 A * 3/1997 Wallis et al. ..... 417/310
6,267,565 B1 7/2001 Seibel et al.
6,913,448 B2 7/2005 Liang et al.
7,207,787 B2 * 4/2007 Liang et al. ..... 418/55.1
7,338,265 B2 3/2008 Grassbaugh et al.
7,364,416 B2 4/2008 Liang et al.
2005/0142017 A1 6/2005 Liang et al.
2008/0175737 A1 * 7/2008 Grassbaugh et al. ..... 418/55.4

OTHER PUBLICATIONS

Wang, Scroll machine using floating seal with backer; Feb. 2008.
Wang, Jun ; Li, Chao ; Ma, Xiaoli ; Liu, Xingwang ; Liu, Zhenquan, Experiment investigation of lubricating oil sealing in working chamber of scroll compressor; Science Press; Mar. 2006. pp. 100-104.
Peng, Bin; Li, Chao ; Liu, Zhenquan, Seal investigation of natural gas invert scroll compressor; Science Press; 2005, pp. 107-110, Issued: Nov. 2005.
Liu, Y.a , Hung, C.a , Chang, Y.b, Mathematical model of bypass behaviors used in scroll compressor; Date: May 23, 2008.
Chen Rong, Wang Wen, Discussion on leaking characters in meso-scroll compressor; Elsevier, ScienceDirect; 2009.02.009; pp. 1433-1441.
Taiwan Patent Office, "Office Action", Aug. 28, 2013.

* cited by examiner

*Primary Examiner* — Peter J Bertheaud
*Assistant Examiner* — Dnyanesh Kasture
(74) *Attorney, Agent, or Firm* — WPAT, PC; Justin King

(57) ABSTRACT

An improved floating apparatus for scroll compressors is disclosed, which is a multi-function device integrating a temperature protection mechanism, a pressure protection mechanism and a backflow-proof mechanism and therefore substantially is a floating seal member with overheating protection, high pressure protection and backflow-proof capabilities. In detail, the present disclosure provides a floating apparatus for scroll compressors that not only can be manufactured easily, but also capable of distributing the acting force resulting from the gliding block for providing better sealing effect while preventing the scroll compressors from being damaged by high temperature and high pressure.

15 Claims, 4 Drawing Sheets

FLOATING APPARATUS FOR SCROLL COMPRESSORS

TECHNICAL FIELD

The present disclosure relates to an improved floating apparatus for scroll compressors, and more particularly, to a multi-function device integrating a temperature protection mechanism, a pressure protection mechanism and a backflow-proof mechanism.

TECHNICAL BACKGROUND

It has been discovered that one of the unique features of scroll compressors is that it is ease to overheat while operating under abnormal conditions, such as operating under a compression ratio exceeding its specification, poor heat dissipation from its system condenser, blocked fan, clogged piping or the likes.

For preventing scroll compressors from being damaged by the aforesaid conditions, one known method is to design an apparatus in the scroll compressors that is specifically used for causing a low-pressure working fluid to flow toward a high-pressure zone, or/and causing a medium-pressure working fluid to a high-pressure zone when any of the aforesaid excessive temperature conditions is encountered, so as to protect scroll compressors from overheating. There are already many such apparatuses available today, such as those disclosed in U.S. Pat. Nos. 5,141,407, 6,267,565, and 7,338,265.

In detail, each of the U.S. Pat. Nos. 5,141,407 and 6,267,565 teaches an apparatus for protecting scroll compressors from high temperature problems, and the U.S. Pat. No. 7,338,265 teaches an apparatus for protecting scroll compressors from high pressure problems, according to that the apparatuses disclosed in U.S. Pat. Nos. 5,141,407 and 6,267,565 are not able to protect scroll compressors from being damaged by high pressure, and the apparatus disclosed in U.S. Pat. No. 7,338,265 is not able to protect scroll compressors from being damaged by high temperature. Thus, there are still a lot to be improved in those apparatuses disclosed in U.S. Pat. Nos. 5,141,407, 6,267,565, and 7,338,265.

Moreover, most current available scroll compressor is configured with a gliding block at the center thereof, which is designed to be driven to move by the pressure variation in the scroll compressor for allowing a high-pressure fluid to flow into a high-pressure chamber while preventing the same from leaking toward a low-pressure chamber as the scroll compressor is actuated. In addition, the aforesaid gliding block further comprises a backflow-proof element for reducing high-pressure backflow and thus preventing damage to the scroll pair of the scroll compressor.

However, as the acting force of the aforesaid gliding block design will concentrate to the center of the corresponding scroll pair, resulting that the contact area between the gliding block and the scroll pair is very small, the sealing between the gliding block and the scroll pair is not satisfactory.

In addition, the backflow-proof element formed in the gliding block is substantially a blind hole having a valve plate disposed therein. However, in reality, such blind hole design will cause the difficulty for machining a gliding block to increase.

TECHNICAL SUMMARY

The object of the present disclosure is to provide an improved floating apparatus for scroll compressors, which is ease to process, capable of distributing the acting force resulting from the gliding block for providing better sealing effect, and capable of preventing the scroll compressors from being damaged by high temperature and high pressure.

To achieve the above object, the present disclosure provides a scroll compressor with improved floating apparatus, comprising: a frame, being divided into a high-pressure zone and a low-pressure zone; a scroll pair, received inside the low-pressure zone; a floating apparatus, disposed on top of the scroll pair while enabling a high-pressure chamber and a medium-pressure chamber to be formed therebetween in a manner that the medium-pressure chamber is connected in communication with the low-pressure zone and the high-pressure chamber is connected in communication with the high-pressure zone; a backflow-proof unit, mounted on the floating apparatus while being disposed at a position between the high-pressure zone and high-pressure chamber; a pressure protection unit, mounted on the floating apparatus while being disposed inside the medium-pressure chamber; and a temperature protection unit, mounted on the floating apparatus while being disposed inside the medium-pressure chamber; wherein, the high-pressure zone and the low-pressure zone is being separated from each other by a partition block; and the frame is further configured with a bracket that is disposed at the bottom of the scroll pair.

In an exemplary embodiment of the present disclosure, the floating apparatus further comprises: a gliding block, being arranged for enabling the top thereof to be positioned inside the high-pressure zone while being configured with a high-pressure via hole and a plurality of radial side holes that are connected in communication with the high-pressure via hole. Thereby, the backflow-proof unit is disposed inside the high-pressure via hole while enabling the pressure protection unit and the temperature protection unit to be positioned respectively at two opposite sides of the gliding block. Moreover, the gliding block is further configured with two medium-pressure passages, each being connected in communication with the low-pressure zone, in a manner that one of the two medium-pressure passages is provided for receiving the pressure protection unit while allowing the same to be positioned between the medium-pressure chamber and the low-pressure zone, and another medium-pressure passage is provided for receiving the temperature protection unit while allowing the same to be positioned between the medium-pressure chamber and the low-pressure zone.

In another exemplary embodiment of the present disclosure, the partition block is formed with a via hole at the center thereof, which is provided for the top of the gliding block to insert therethrough; and moreover, the partition block is formed with a seal mounting surface and the gliding block is formed with a ring flange mounting surface that is coaxially arranged with the axis of the high-pressure via hole while extending axially, and seal mounting surface can be arranged for selectively enabling the same to engage with and detach from the ring flange mounting surface.

In another exemplary embodiment of the present disclosure, the scroll pair is composed of a fixed scroll and a rotary scroll, that are arranged convoluting each other while enabling a low-pressure suction inlet, that is connected in communication with the low-pressure zone, to be formed therebetween.

In another exemplary embodiment of the present disclosure, the fixed scroll is formed with a discharge port at a position on top of the hub thereof in a manner that the discharge port is connected in communication with the low-pressure suction inlet and the high-pressure chamber; and moreover, the fixed scroll is formed with a receiving recess at a position on top of the hub thereof, that is provided for receiving the floating apparatus therein so as to enable the high-pressure chamber to be formed between the gliding block and the receiving recess. In addition, the fixed scroll is formed with a ring flange at a position on top of the hub thereof, that is used for enabling the medium-pressure chamber to be formed between the gliding block and the ring flange; and also the fixed scroll is formed with a medium-pressure passage in a manner that the medium-pressure passage is connected in communication respectively with the medium-pressure chamber and the low-pressure suction inlet.

In another exemplary embodiment of the present disclosure, the temperature protection unit is substantially a temperature responsive valve, composed of a block ring and a disk-like valve element in a manner that the ring block is arranged at a position corresponding to a first pressure passage while the disk-like valve element is disposed inside the medium-pressure passage.

In another exemplary embodiment of the present disclosure, the pressure protection unit is substantially a pressure relief valve, composed of a block element, an elastic element and a spherical-shape element, in which the block element is formed with a stair-shaped hole that is connected in communication with the low-pressure zone; the elastic element is disposed inside the block element while enabling an end of the elastic element to abut against the inner wall of the stair-shaped hole and another end thereof to abut against the spherical-shape element; and the spherical-shape element is disposed inside the medium-pressure passage. It is noted that the elastic element can be a spring.

In another exemplary embodiment of the present disclosure, an end of the gliding block where the high-pressure via hole is formed is disposed inside the high-pressure chamber and has a first sealing element disposed thereat; and there is a second sealing element disposed about the periphery of the bottom of the gliding block. Each of the first and the second sealing elements is formed with a pressure-relief groove.

In another exemplary embodiment of the present disclosure, the backflow-proof unit is substantially a baffle, and correspondingly, there is a flange element, such as a C-shaped ring, disposed at the top of the high-pressure via hole, to be used for barring the baffle.

To sum up, the scroll compressor with improved floating apparatus has at least the following advantages:

(1) Since the contact area between the gliding block and the medium-pressure chamber of the fixed scroll is increased, resulting that the acting force exerting upon the scroll pair by the gliding block is being distributed, not only the stability of the dynamic operation of the scroll compressor is enhanced, but also the operation performance is increased.

(2) As the high-pressure via hole of the gliding block is designed as a via hole instead of the prior-art blind hole design, the machining of the gliding block is comparatively easily, not to mention that the backflow-proof unit in the present disclosure is blocked and barred by the use of a ring element, such as a C-shape ring, that can be assembled and mounted to the top of the high-pressure via hole easily.

(3) The sealing of the present disclosure is improved by the sealing elements arranged respective between the high-pressure chamber and the medium-pressure chamber, and the medium-pressure chamber and the low-pressure zone.

(4) Since the gliding block is configured with the temperature protection unit and the pressure protection unit, it can respond to any abnormal high temperature and high pressure for activating a pressure-drop operation and/or a temperature dissipating operation accordingly in respective or simultaneously and thus the damage protection for the scroll compressor is improved.

Further scope of applicability of the present application will become more apparent from the detailed description given hereinafter. However, it should be understood that the detailed description and specific examples, while indicating exemplary embodiments of the disclosure, are given by way of illustration only, since various changes and modifications within the spirit and scope of the disclosure will become apparent to those skilled in the art from this detailed description.

BRIEF DESCRIPTION OF THE DRAWINGS

The present disclosure will become more fully understood from the detailed description given herein below and the accompanying drawings which are given by way of illustration only, and thus are not limitative of the present disclosure and wherein.

DESCRIPTION OF THE EXEMPLARY EMBODIMENTS

For your esteemed members of reviewing committee to further understand and recognize the fulfilled functions and structural characteristics of the disclosure, several exemplary embodiments cooperating with detailed description are presented as the follows.

Figure 1:
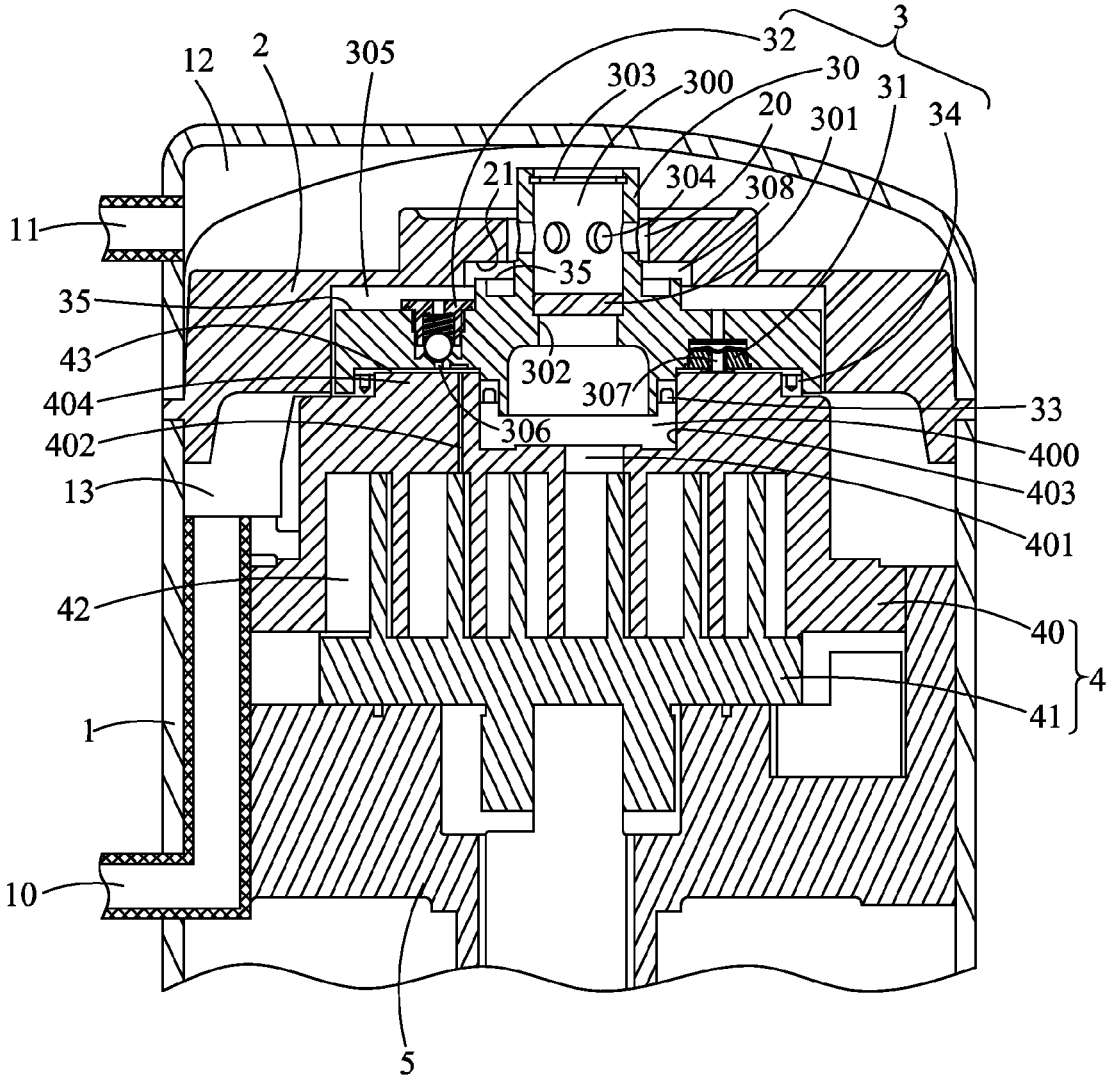
FIG. 1 is a sectional view of a scroll compressor with improved floating apparatus according to the present disclosure.

Please refer to FIG. 1, which is a sectional view of a scroll compressor with improved floating apparatus according to the present disclosure. As shown in FIG. 1, the scroll compressor with improved floating apparatus comprises: a frame 1, a partition block 2, a floating apparatus 3, a backflow-proof unit 301, a temperature protection unit 31, a pressure protection unit 32, a scroll pair 4 and a bracket 5.

The frame 1 is configured with an inlet 10 and an outlet 11 and is divided into a high-pressure zone 12 and a low-pressure zone 13 in a manner that the high-pressure zone 12 is connected in communication with the outlet 11 while the low-pressure zone 13 is connected in communication with the inlet 10.

The partition block 2 is disposed inside the frame 1 at a position between the high-pressure zone 12 and the low-pressure zone 13 for separating the two. Moreover, the partition block 2 is configured with a via hole 20, that is formed at the center thereof, and a seal mounting surface 21.

The scroll pair 4 is composed of a fixed scroll 40 and a rotary scroll 41, that are arranged convoluting each other while enabling a low-pressure suction inlet 42, that is connected in communication with the low-pressure zone 13, to be formed therebetween. Moreover, the fixed scroll 40 is formed with a discharge port 401 at a position on top of the hub thereof, and also, the fixed scroll 40 is further formed with a receiving recess 403 at a position on top of the hub thereof, that is provided for receiving the floating apparatus 3 therein. In addition, the fixed scroll is further formed with a ring flange 404 at a position on top of the hub thereof, and also the fixed scroll is further formed with a medium-pressure passage 402.

The floating apparatus 3, being movably disposed between the scroll pair 4 and the partition block 2, is composed of a gliding block 30, a first sealing element 33 and a second sealing element 34, in which the gliding block 30 is mounted to the top of the fixed scroll 40 while being received inside the receiving recess 403 for enabling a high-pressure chamber 400 to be formed between the gliding block 30 and the receiving recess 403 as well as a medium-pressure chamber 43 to be formed between the gliding block 30 and the ring flange 404. In addition, as the discharge port 401 is arranged in communication with the high-pressure chamber 400, the high-pressure chamber 400 is substantially connected in communication respectively with the high-pressure zone 12 and the low-pressure suction inlet 42. Moreover, As the medium-pressure chamber 43 is formed in communication with the medium-pressure passage 402, the medium-pressure chamber 43 is also capable of communicating with the low-pressure suction inlet 42.

The top of the gliding block 30 is inserted into the via hole 20 to be positioned inside the high-pressure zone 12, whereas the gliding block 30 is further being configured with a high-pressure via hole 300 and a plurality of radial side holes 304.

There are a first pressure passage 305 and a second pressure passage 308 being formed between the gliding block 30 and the partition block 2 in a manner that the first pressure passage 305 is connected in communication with the second pressure passage 308 for allowing the low-pressure zone 13 and the high-pressure zone 12 to communicate with each other therethrough. Moreover, there are two medium-pressure passages 306, 307 being formed in the gliding block 30 at positions corresponding to the first pressure passage 305 for enabling the two medium-pressure passages 306, 307 to connected in communication with the first pressure passage 305.

Figure 7:
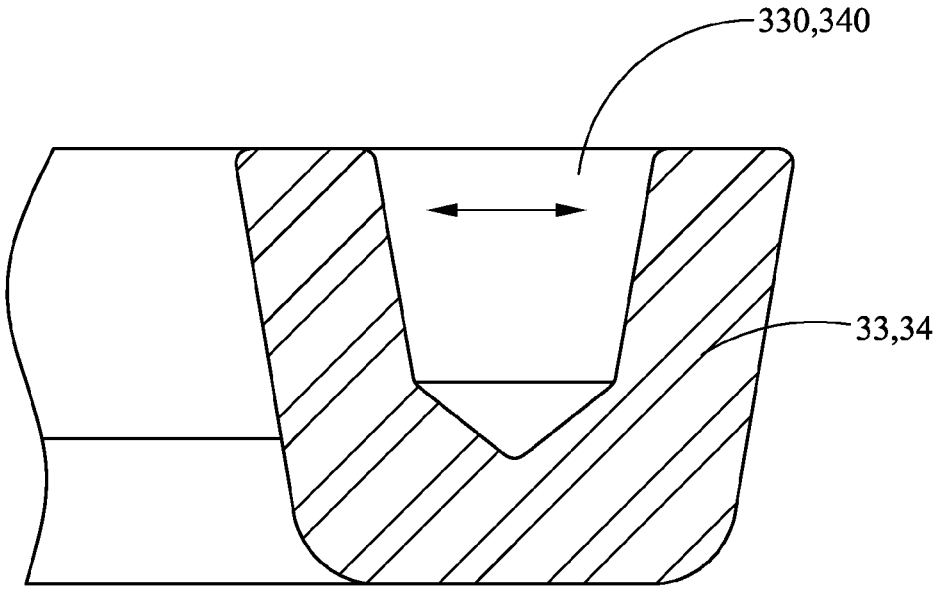
FIG. 7 is a sectional diagram showing a working sealing ring of the present disclosure.

In addition, the first sealing element 33 is disposed at the bottom of the gliding block 30 at a position proximate to the high-pressure via hole 300, which is used for preventing the fluid inside the high-pressure chamber 400 to leak into the medium-pressure chamber 43. Similarly, the second sealing element 34 is also disposed at the bottom of the gliding block 30 about the periphery thereof, which is used for preventing the fluid inside the medium-pressure chamber 43 to leak into the low-pressure zone 13. As shown in FIG. 7, each of the sealing elements 33, 34 is formed with a pressure relief groove, which are the pressure relief groove 330 in the first sealing element 33 and the pressure relief groove 340 in the second sealing element 34, by that cross section of each sealing element 33, 34 is a U-shape cross section. Thereby, the aforesaid high-pressure chamber 400 and the medium-pressure chamber 43 can be formed from the assembling of the fixed scroll 40, the floating apparatus 3, the first sealing element 33 and the second sealing element 34.

The backflow-proof unit 301 is substantially a baffle, movably disposed inside the high-pressure via hole 300 while being supported by a flange 302 also mounted inside the high-pressure via hole 300, and correspondingly, there is a flange element 303, such as a C-shaped ring, disposed at the top of the high-pressure via hole 300 to be used for barring the backflow proof unit 301. It is noted that each of the plural radial side holes 304 is connected in communication with the high-pressure zone 12. In addition, the gliding block 30 is formed with a ring flange mounting surface 35 that is extending axially and is coaxially arranged with the axis of the high-pressure via hole 300, by that the seal mounting surface 21 is arranged for enabling the same to engage with the ring flange mounting surface 35 so as to construct the abovementioned high-pressure zone 12 and the low-pressure zone 13.

Figure 4:
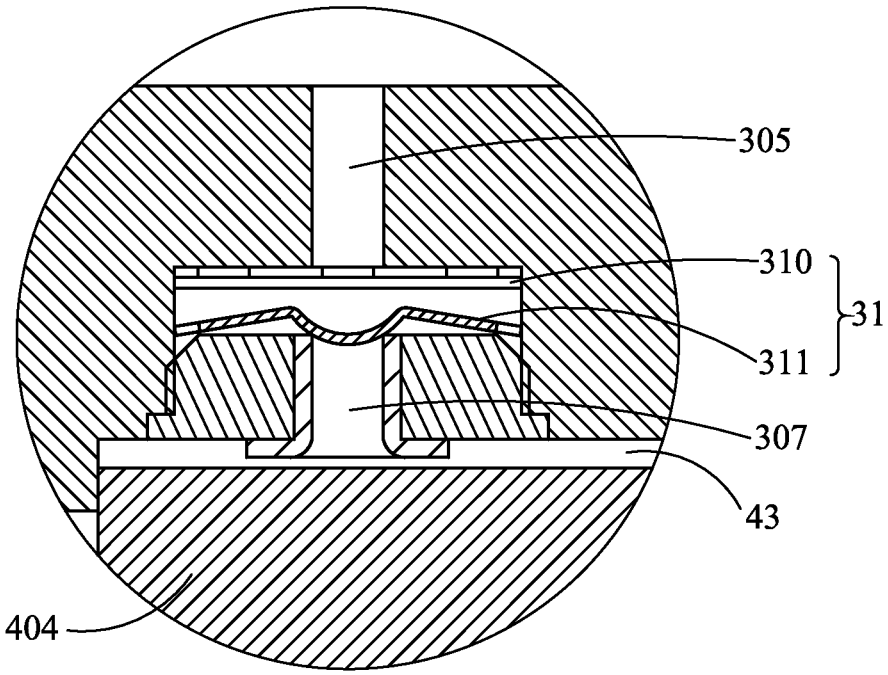
FIG. 4 is a sectional diagram showing a temperature protection unit used in the present disclosure that is not activated.

The temperature protection unit 31, being disposed at a side of the gliding block 30, is substantially temperature responsive valve arranged between the medium-pressure passage 307 and the first pressure passage 305 at a position proximate to the high-pressure via hole 300. As shown in FIG. 4, the temperature protection unit 31 is composed of a block ring 310 and a disk-like valve element 311 made of a bimetallic material, in a manner that the ring block 310 is arranged at a position corresponding to a first pressure passage 305 while the disk-like valve element 311 is disposed inside the medium-pressure passage 307 to be used for selectively opening or closing the same.

Figure 2:
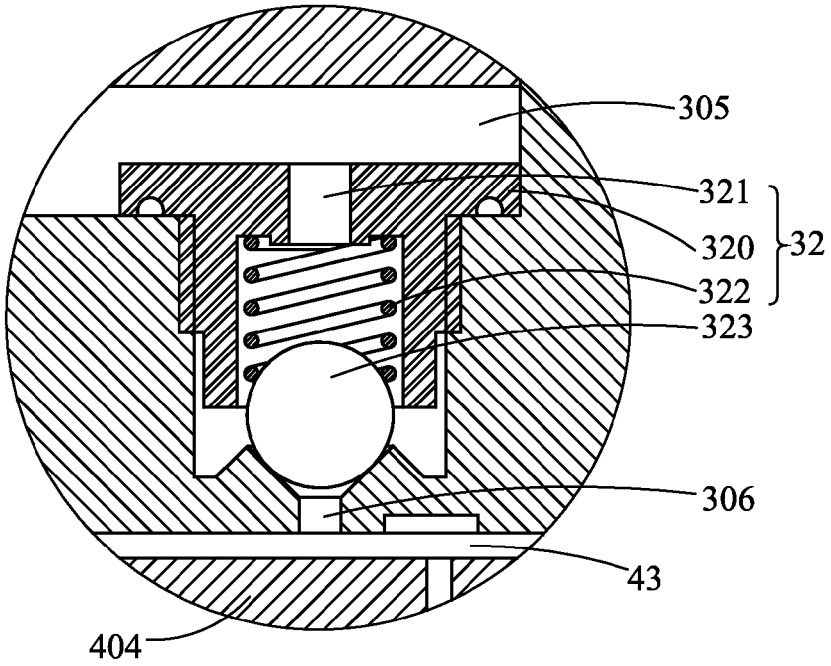
FIG. 2 is a sectional diagram showing a pressure protection unit used in the present disclosure that is not activated.

The pressure protection unit 32, being disposed at another side of the gliding block 30, is substantially a pressure relief valve being arranged between another medium-pressure passage 306 and the first pressure passage 305. As shown in FIG. 2, the pressure relief valve 32 is composed of a block element 320, an elastic element 322 and a spherical-shape element 323, in that the block element 320 is formed with a stair-shaped hole 321 that is connected in communication with the low-pressure zone 13 by way of the first pressure passage 305; the elastic element 322, being a spring, is disposed inside the block element 320 while enabling an end of the elastic element 322 to abut against the inner wall of the stair-shaped hole 321 and another end thereof to abut against the spherical-shape element 323; and the spherical-shape element 323 is disposed inside the medium-pressure passage 306 to be used for selectively opening or closing the same. Moreover, the bracket 5, being mounted inside the frame 1, is disposed at the bottom of the scroll pair.

Figure 6:
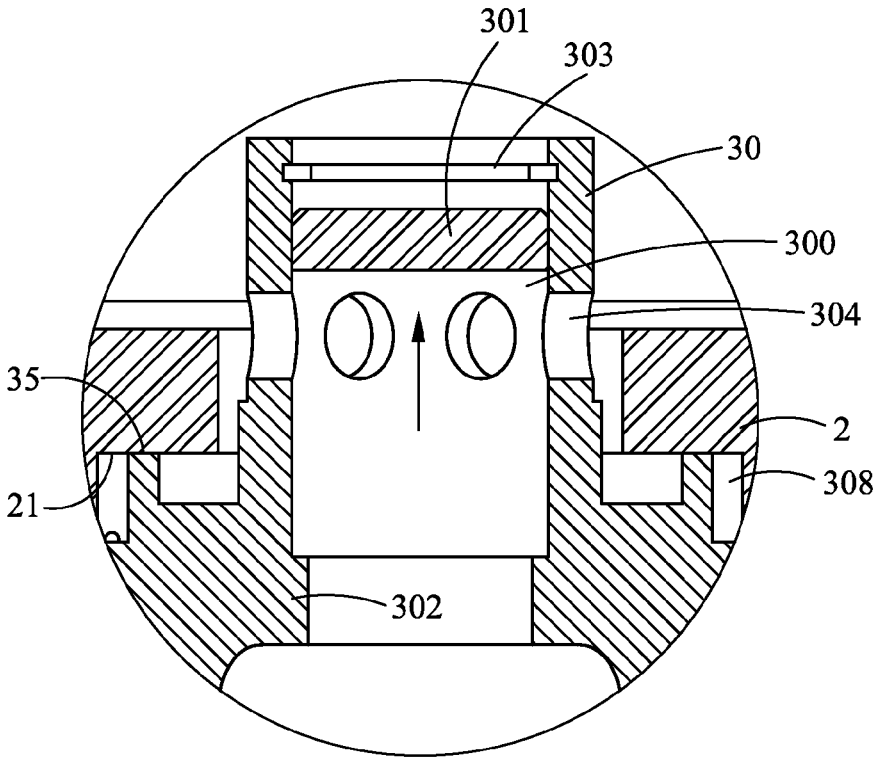
FIG. 6 is a sectional diagram showing an operating gliding block of the present disclosure.

As shown in FIG. 6, a working fluid that is being fed into the low-pressure zone 13 through the inlet 10 will be sucked into the scroll pair 4 through the low-pressure suction inlet 42 so as to be pressurized into a high-pressure fluid. Thereafter, the high-pressure fluid will flow into the high-pressure chamber 400 through the discharge port 401 to be used for forcing the gliding block 30 to move, resulting the seal mounting surface 21 to engage with the ring flange mounting surface 35 and thus sealing the second pressure passage 308. That is, the communication between the high-pressure zone 12 and the low-pressure zone 13 is closed. Simultaneously, the high-pressure fluid also flows into the high-pressure via hole 300 for actuating the backflow-proof unit 301, resulting the radial side holes 304 to connect in communication with the high-pressure chamber 400 so as to enable the high-pressure fluid to flow into the high-pressure zone 12 and then out of the same through the outlet 11.

If the high-pressure fluid in not powerful enough to drive the gliding block 30, the gliding block will move back to its original position for enabling the first pressure passage 305 to communicate with the second pressure passage 308 as normal, and enabling the seal mounting surface 21 to detach from contacting with the ring flange mounting surface 35, i.e. the communication between the high-pressure zone 12and the low-pressure zone 13 is recovered. Simultaneously, the backflow-proof unit 301 is restored back to its original position, resulting to the high-pressure via hole 300 to be closed and thus preventing the high-pressure fluid that was fed into the high-pressure zone 12 in the previous process from flowing back into the high-pressure chamber 400.

Figure 3:
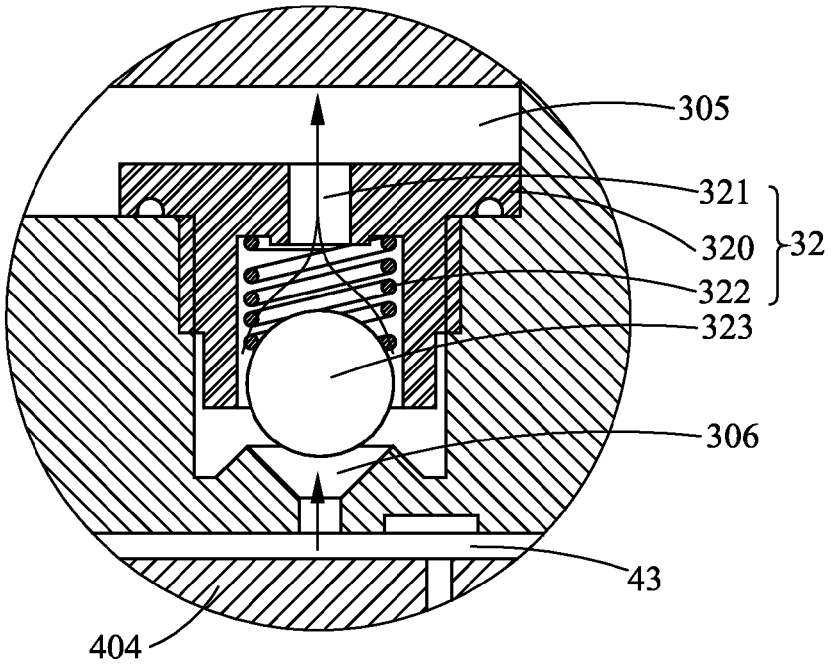
FIG. 3 is a sectional diagram showing a pressure protection unit used in the present disclosure that is being activated.

As shown in FIG. 2 and FIG. 3, the fluid inside the medium-pressure chamber 43 will be pressurized by the scroll pair 4 into a so-called medium-pressure fluid, and if the pressure of the medium-pressure fluid exceeds a specific pressure value, the medium-pressure fluid will flow into the medium-pressure chamber 43 through the medium pressure passage 402 to be used for pushing the spherical-shape element 323. Since the medium-pressure passage 306 is capable of communicating with the first pressure passage 305 by way of the stair-shaped hole 321 of the block element 320, the spherical-shape element 323 will be pushed away by the medium-pressure fluid exceeding the specific pressure value, resulting that the medium-pressure passage 306 is opened for allowing the medium-pressure fluid to flow into the low-pressure zone 13 through the medium-pressure chamber 43, causing the pressure inside the scroll compressor to drop and thus protecting the scroll compressor from being damaged by high pressure. As the pressure is dropped, the spherical-shape element 323 will be pushed back to its original position by the elastic element 322 and thus the medium-pressure passage 306 is closed.

Figure 5:
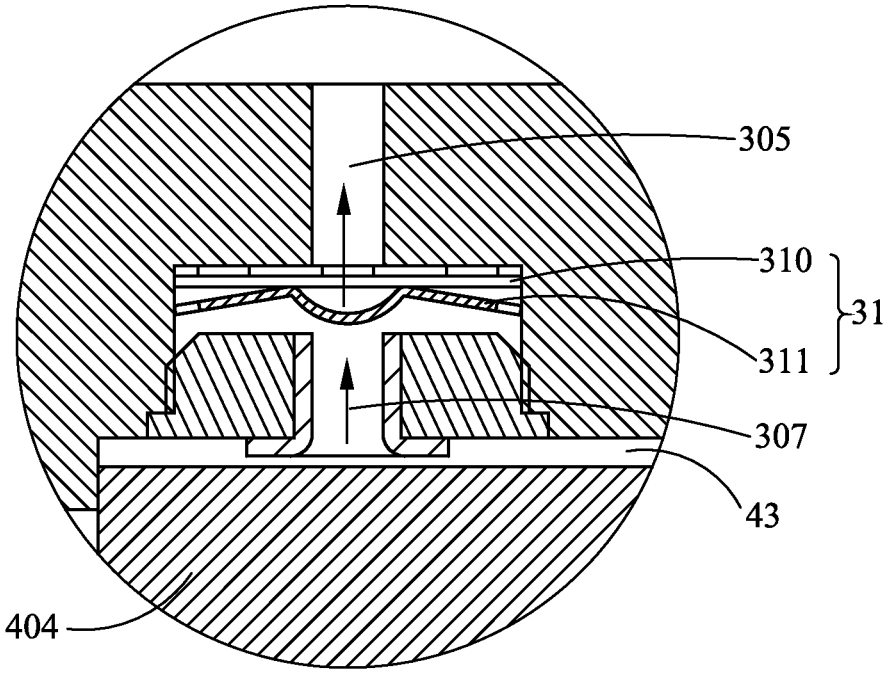
FIG. 5 is a sectional diagram showing a temperature protection unit used in the present disclosure that is being activated.

As shown in FIG. 4 and FIG. 5, when the temperature inside the medium-pressure chamber 43 exceeds a specific threshold temperature, the disk-like valve element 311 will be actuated to open the medium-pressure passage 307 for enabling the medium-pressure chamber 43 to communicate with the low-pressure zone 13. That is, the disk-like valve element 311 will be deformed to an extend sufficient enough at the threshold temperature for opening the medium-pressure passage 307, and thus allowing the medium-pressure fluid inside the medium-pressure chamber 43 to into the low-pressure zone 13 through the medium-pressure passage 307, resulting that the heat inside the scroll compressor is dissipated as well as the pressure of the same is dropped, and thus the scroll compressor is protected from being damaged by high temperature and high pressure.

Please refer to FIG. 7, which is a sectional diagram showing a working sealing ring of the present disclosure. Since the first sealing element 33 is disposed between the high-pressure chamber 400 and the medium-pressure chamber 43, it is used primarily for preventing the high-pressure fluid from leaking from the high-pressure chamber 400 into the medium-pressure chamber 43; and since the second sealing element 34 is disposed between the medium-pressure chamber 43 and the low-pressure zone 13, it is used primarily for preventing the fluid in the medium-pressure chamber 43 from leaking into the low-pressure zone 13. Operationally, when the pressure relief grooves 330, 340 is subjected to the pressure of a high-pressure fluid, the corresponding sealing elements 33 and 34 will be forced to stretched outward, resulting the two sealing elements 33 and 34 to be able to provide a better sealing effect for preventing any fluid leakage.

With respect to the above description then, it is to be realized that the optimum dimensional relationships for the parts of the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present disclosure.

What is claimed is:

1. A scroll compressor with an improved floating apparatus, comprising:

a frame, comprising:

a high-pressure zone; and a low-pressure zone;

a scroll pair, disposed inside said low-pressure zone;

a floating apparatus, movably disposed on top of said scroll pair between said high-pressure zone and said low-pressure zone, forming a high-pressure chamber and a medium-pressure chamber, wherein said medium-pressure chamber is in communication with said low-pressure zone and said high-pressure chamber is in communication with said high-pressure zone;

a backflow-proof unit, mounted on said floating apparatus and disposed between said high-pressure zone and said high-pressure chamber;

a pressure protection unit, mounted inside said floating apparatus, wherein said pressure protection unit enables fluid communication between said medium-pressure chamber and said low-pressure zone in response to a pressure of said medium-pressure chamber; and a temperature protection unit, mounted inside said floating apparatus, wherein said temperature protection unit enables fluid communication between said medium-pressure chamber and said low-pressure zone in response to a temperature of said medium-pressure chamber.

2. The scroll compressor with improved floating apparatus of claim 1, further comprising a partition block disposed between, and separating, said high-pressure zone and said low-pressure zone, said partition block further comprising:

a partition block via hole; and a seal mounting surface.

3. The scroll compressor with improved floating apparatus of claim 2, wherein said floating apparatus further comprises a gliding block, comprising:

a high-pressure via hole, with said backflow-proof unit disposed therein;

a plurality of radial side holes, in communication with said high-pressure via hole; and a ring flange mounting surface, extending axially, and coaxial to said high-pressure via hole;

whereina top of said gliding block is disposed though said partition block via hole within said high-pressure zone, said seal mounting surface is disposed to engage with said rind flame mounting surface; and said pressure protection unit and said temperature protection unit are disposed respectively at two sides of said gliding block.

4. The scroll compressor with improved floating apparatus of claim 3, wherein said floating apparatus further comprises:

a first sealing element, disposed adjacent to said scroll pair and encircling a bottom of said high pressure via hole, separating said high-pressure chamber and said medium-pressure chamber; and a second sealing element, disposed about a periphery of said scroll pair, separating said medium pressure chamber and said low pressure zone.

5. The scroll compressor with improved floating apparatus of claim 4, wherein said first sealing element comprises a pressure-relief groove and said second sealing elements comprises a pressure-relief groove.

6. The scroll compressor with improved floating apparatus of claim 3, wherein said backflow-proof unit comprises a baffle, and said gliding block further comprises a flange element disposed at the top of said high-pressure via hole, wherein said flange element prevents said backflow proof unit from exiting said high pressure via hole.

7. The scroll compressor with improved floating apparatus of claim 6, wherein said flange element is C-shaped.

8. The scroll compressor with improved floating apparatus of claim 3, wherein said gliding block further comprises:

a first medium-pressure passages, in communication with said low-pressure zone and said medium-pressure chamber; and a second medium-pressure passage, in communication with said low-pressure zone and said medium-pressure chamber;

wherein said pressure protection unit is disposed in said first medium-pressure passage, and said temperature protection unit is disposed in said second medium-pressure passage.

9. The scroll compressor with improved floating apparatus of claim 8, wherein said temperature protection unit comprises:

a block ring; and a disk-like valve element, disposed inside said second medium-pressure passage.

10. The scroll compressor with improved floating apparatus of claim 8, wherein said pressure protection unit comprises:

a block element, with a stair-shaped hole in communication with said low-pressure zone;

a spherical-shape element, disposed inside said first medium-pressure passage; and an elastic element, disposed inside said block element, wherein a first end of said elastic element abuts against an inner wall of said stair-shaped hole and a second end of said elastic element abuts against said spherical-shape element.

11. The scroll compressor with improved floating apparatus of claim 10, wherein said elastic element comprises a spring.

12. The scroll compressor with improved floating apparatus of claim 1, wherein the scroll pair comprises:

a rotary scroll; and a fixed scroll, arranged on top of and convoluting said rotary scroll, and comprising:

a discharge port, centrally disposed on said fixed scroll, in communication with said high-pressure chamber;

a receiving recess, centrally disposed atop said fixed scroll, wherein said high-pressure chamber is disposed between said receiving recess and said floating apparatus;

a ring flange, disposed on top of said fixed scroll, wherein said medium-pressure chamber is disposed between said floating apparatus and said ring flange; and a third medium-pressure passage, in communication with said medium-pressure chamber.

13. The scroll compressor with improved floating apparatus of claim 1, wherein said temperature protection unit comprises a temperature responsive valve.

14. The scroll compressor with improved floating apparatus of claim 1, wherein said pressure protection unit is comprises a pressure relief valve.

15. The scroll compressor with improved floating apparatus of claim 1, wherein said frame further comprises bracket, disposed beneath said scroll pair.

* * * * *